United States Patent [19]

Zlupko et al.

[11] 4,358,747

[45] Nov. 9, 1982

[54] CURRENT-LIMITING FUSE WITH IMPROVED MEANS FOR INTERRUPTING LOW OVERCURRENTS

[75] Inventors: John E. Zlupko, Marlton, N.J.; Ben L. Damsky, Philadelphia, Pa.

[73] Assignee: General Electric Company, Philadelphia, Pa.

[21] Appl. No.: 279,390

[22] Filed: Jul. 1, 1981

[51] Int. Cl.[3] ..... H01H 85/38

[52] U.S. Cl. ..... 337/273; 337/279

[58] Field of Search ..... 337/158, 159, 161, 273, 337/274, 279, 281, 296

[56] References Cited

U.S. PATENT DOCUMENTS

| | | | |
|---|---|---|---|
| 3,864,655 | 2/1975 | Kozacka | 337/159 X |
| 3,949,342 | 4/1976 | Kozacka | 337/279 X |
| 4,054,858 | 10/1977 | Jacobs, Jr. | 337/296 X |
| 4,179,677 | 12/1979 | Kozacka | 337/161 |
| 4,183,004 | 1/1980 | Kozacka | 337/279 X |

*Primary Examiner*—George Harris

*Attorney, Agent, or Firm*—William Freedman

[57] ABSTRACT

This current-limiting fuse comprises a fusible element having a predetermined location at which an arc will be initiated when prolonged overcurrents of relatively low value have persisted for a predetermined duration. For increasing the arc voltage developed by said arc, an electrical insulating member is disposed about the fusible element in a position where at least a portion of the arc will burn within the insulating member and cause vapors to be evolved from the material of the insulating member. The insulating member is of a material that evolves substantially no vapors or gases at the temperatures reached by the insulating material prior to arc-initiation during prolonged overcurrents of up to one hour in duration. This material is a baked material, a major portion of which is hydrated aluminum silicate including water of hydration that is released only at temperatures in excess of those attained by the insulating material during prolonged overcurrents as long as one hour.

11 Claims, 3 Drawing Figures

CURRENT-LIMITING FUSE WITH IMPROVED MEANS FOR INTERRUPTING LOW OVERCURRENTS

BACKGROUND

This invention relates to an electric fuse of the current-limiting type and, more particularly, to a fuse of this type which can interrupt a wide range of abnormal currents but is especially adapted to interrupt relatively low overcurrents.

It is well recognized that a type of abnormal current that is difficult for a current-limiting fuse to interrupt is a relatively low overcurrent that persists for a long period of time before melting the fusible element or elements of the fuse. For example, in a typical current-limiting fuse, an overload current of 1.5 to 3 times the steady-state rating of the fuse may persist for an hour or even more before it melts the fusible elements of the fuse.

To assist in extinguishing the arc or arcs formed upon such melting, it has been common to provide, in each region where an arc is anticipated, structure of gas-evolving material which evolves an arc-extinguishing gas when exposed to the arc. Examples of such fuses are disclosed in U.S. Pat. Nos. 3,766,509-Cameron; 3,238,333-Kozacka; 4,167,723-Wilks, 3,437,971-Mikulecky, and 3,562,162-Pitha.

In studying typical fuses of this general type, we have observed that during a prolonged period of low overcurrent such as referred to above and prior to arc-initiation, the gas-evolving structure evolves substantial amounts of gases in response to heating of the fuse elements. Such gas evolution is undesirable for at least the following reasons:

1. The total available amount of easily-evolved gas is limited, and any amount lost before arc-initiation is not available for arc-extinction. Insufficient gas flow at the time of arc-initiation could interfere with arc-extinction.
2. Gas evolved before arcing may cause excessive pressure to develop in the fuse.
3. The gas release process is endothermic so that the desired temperature rise of the fusible element or elements can be retarded by such gas evolution. This may distort the time-to-melt v. current curve of the fuse by increasing the melting time at low overcurrents.

SUMMARY

Accordingly, an object of our invention is to provide, for a current-limiting fuse, gas-evolving structure which: (1) is capable of evolving the required quantities of gases for readily extinguishing the arcs produced by fuse-element melting after prolonged periods of low overcurrent, and (2) evolves little or no significant quantities of gas prior to arc-initiation under such low overcurrent conditions.

Another object is to provide gas-evolving structure capable of performing as in the immediately preceding paragraph for protracted overcurrents of approximately one hour in duration.

Another object is to provide gas-evolving structure capable of performing as stated in the first object and also having good electrical insulating properties which are maintained despite prolonged heating and despite the arcing which accompanies interruption.

In carrying out our invention in one form, we provide a high-voltage current-limiting fuse comprising a fusible element and means at a predetermined location on the fusible element for causing the element to melt at said predetermined location in response to prolonged overcurrents of relatively low value, thereby initiating an arc at said location when said prolonged overcurrents have persisted for a predetermined duration. For increasing the arc voltage developed by the arc, there is provided gas-evolving means comprising an electrical insulating member disposed about the fusible element in the region of said location and at a point sufficiently close to said location that at least a portion of the arc burns within said insulating member and causes vapors to be evolved from the material of the insulating member. The insulating member is of a material that evolves substantially no vapors or gas at the temperatures reached by said insulating member prior to arc-initiation during prolonged overcurrents of up to one hour in duration.

In one form of the invention, the insulating member is of a baked material, a major portion of which is hydrated aluminum silicate including water of hydration that is released only at temperatures in excess of those attained by said insulating member during prolonged overcurrents as long as one hour. The material is baked for several hours at temperatures up to at least the value reached by the insulating member during prolonged overcurrents as long as one hour.

BRIEF DESCRIPTION OF DRAWINGS

For a better understanding of the invention, reference may be had to the following description taken in connection with the drawings, wherein.

DETAILED DESCRIPTION OF PREFERRED EMBODIMENT

Figure 1:
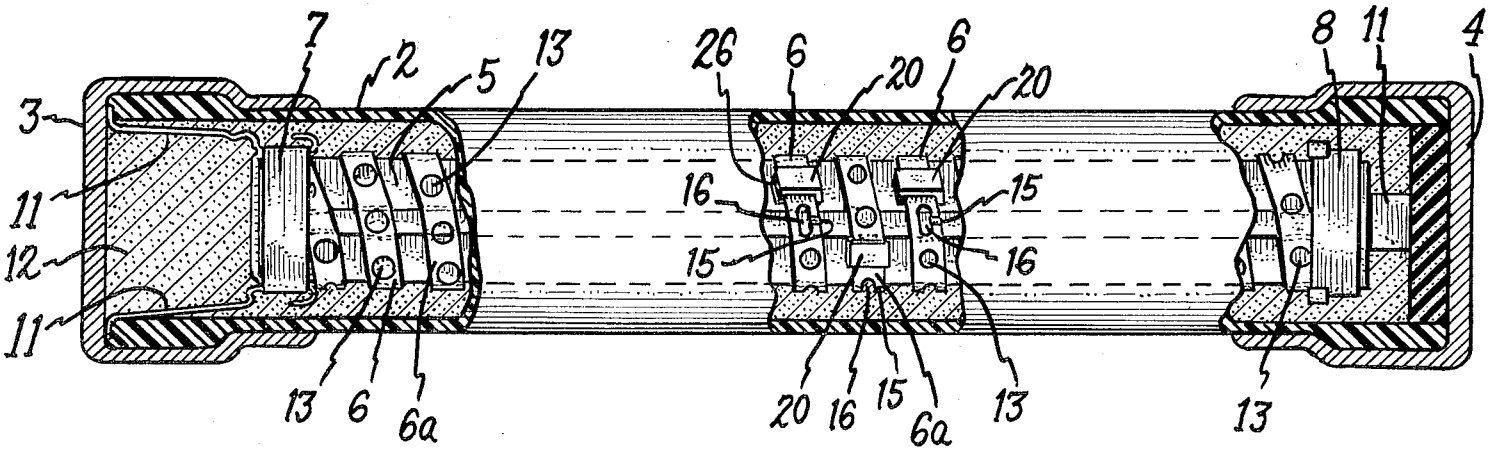
FIG. 1 is a sectional view through a high voltage current-limiting fuse embodying one form of our invention.

Referring now to FIG. 1, there is shown a high-voltage current-limiting fuse comprising a tubular casing 2 of electrical insulating material closed at its opposite ends by metal end caps 3 and 4. Within the casing 2 is an insulating core 5 on which are spirally wound two fusible elements 6 and **6*a* of ribbon form extending along the length of the core. Arranged at opposite ends of core 5 in electrical contact with the ends of fusible elements 6 and 6*a* are conductive terminal clamp members 7 and 8 which electrically connect fusible elements 6 and 6*a* to the conductive end caps 3 and 4, respectively, by means of outwardly extending fingers 11. Filling the casing 2 is a pulverulent filler 12, preferably of quartz sand, in which the core 5 and the fusible elements 6 and 6*a*** are embedded. The depicted core, filler, and casing structure are similar to those disclosed in U.S. Pat. No. 3,562,162-Pitha, assigned to the assignee of the present invention and incorporated by reference in the present application.

The illustrated fuse is a circuit protective device which acts in a known manner to interrupt the current therethrough in the event the current should rise to an abnormally high value. If the abnormal current is a fault current, it will rapidly rise toward a value tens of times higher than normal steady-state current, quickly melting portions of the fusible elements 6 and 6a and producing arcs which vaporize the molten metal and additional metal of the fusible elements 6 and 6a. The hot metal vapors resulting from such vaporization rapidly expand into the spaces between the granules of filler material 12, where they condense and are no longer available for current conduction. This condensing and cooling action builds up in the current path a high arc voltage which limits the current through the fuse to a small fraction of that available in the circuit and also forces the current to zero before the next natural current zero. Under fault current conditions, arcing is initiated at regions of reduced cross-section in the fusible elements 6 and 6a formed by perforations 13 in the fusible elements.

If the abnormal current is an overcurrent, rather than a fault current, the fusible elements do no melt immediately but melt only after the overcurrent has persisted for a predetermined period, the duration of which is inversely related to the current magnitude. For low level overcurrents, such as 1.5 to 3 times steady-state current, the fusible elements may conduct for an hour or even more before melting. To limit this period, it is conventional to provide each fusible element with one or more overlays capable of producing the so-called "M-effect". In this regard, each overlay is of a material, such as tin, which has a much lower melting point than the silver of the ribbon-type fuse elements. When the overlay temperature reaches the melting point of the overlay material, the overlay material reacts metallurgically with the silver to form an alloy. This alloy has a relatively high resistance and a much lower melting point than the silver and causes a relatively rapid melting of the fusible element once the overlay starts to melt. Such melting produces a gap in the fusible element across which an arc is initiated. The arc burns the fusible element back to lengthen the gap and also causes gases to be evolved, in a manner soon to be described. These gases play an important role in extinguishing the low current arc, as will soon be described.

The above-described overlays are shown on fuse elements 6 and 6a at 15. Each overlay 15 is positioned at a region of the fusible element which is of reduced cross-section as a result of an elongated perforation 16 provided in the fusible element in this region. On protracted overcurrents, the fusible element melts at the overlay, as described above, and the resulting arc burns back the fusible element, forming the above-described gap. Each fusible element is preferably provided with a plurality of regions of restricted cross-section which are provided with overlays of this type where arcs are formed in the above-described manner when the fusible element melts in response to protracted low level overcurrents.

For evolving gases to increase the arc voltage and thus aid in extinguishing such arcs, each of the fusible elements is provided with a plurality of beads 20, respectively located adjacent the regions where the above-described arcs are established. Each of these beads is of an electrical insulating material capable of reacting with the arc to generate the desired gases. A preferred configuration of such a bead is shown and claimed in application Ser. No. 270,561 Leach et al, filed on June 4, 1981, and assigned to the assignee of the present invention, which application is incorporated by reference in the present application.

Figure 2:
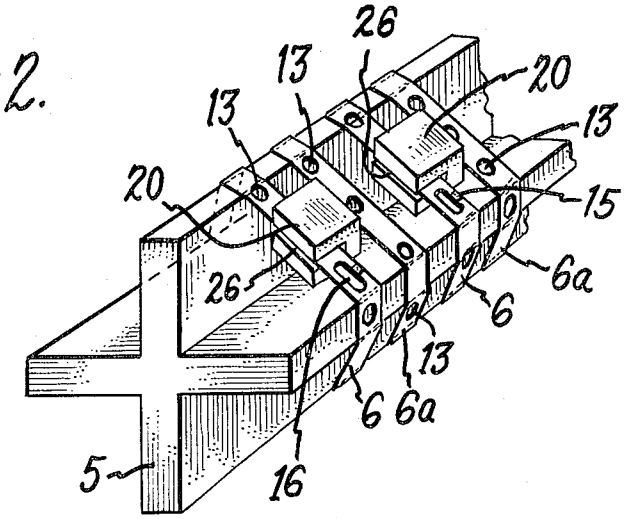
FIG. 2 is an enlarged perspective view in simplified form of the certain components contained in the fuse of FIG. 1.

Referring to our FIG. 2, each bead comprises a block 20 of electrical insulating material which has a slit 26 in it. The block 20 is preferably assembled onto the ribbon-type fusible element after the fusible element has been wound on the core 5. This is done by slipping the block 20 onto the fusible element from the side of the fusible element, the fusible element entering the slit 26 through the open mouth of the slit at one side of the block.

When the above-described arc burns back along the fusible element, one of its terminals enters the adjacent bead 20 through the slit 26. As this occurs, the arc quickly heats to a high temperature the region of the bead that is in proximity to the arc, causing the bead rapidly to evolve the desired arc-extinguishing gases, or vapors. These gases and the constricting action of the walls of the slit 26 act to effectively extinguish the arc.

During the protracted period when the fusible elements 6 and 6a are carrying low level overcurrents, the temperature of the fusible elements in the regions of the beads can rise to relatively high levels. The extent of this temperature rise is limited by the presence of the "M-effect" overlays and depends upon the material of these overlays. With an overlay of tin, we estimate that the fusible element in the region of a bead 20 rises to about 350° C. before melting of the fusible element at the overlay occurs.

As pointed out in the introductory portion of this specification, temperatures in this range maintained for substantial durations are capable of causing typically-used gas-evolving materials to evolve substantial quantities of gases. This is undesirable for at least the three reasons set forth in the introductory portion, and especially because it can materially reduce the quantity of gases that are available for arc-extinction when the arc is initiated.

An object of our invention is to limit to insignificant quantities the volume of gases evolved prior to arc-initiation by protracted low levels of overcurrent requiring up to approximately one hour for fuse melting. In one embodiment of our invention, we are able to achieve this object by forming our beads 20 from a completely inorganic material that (1) is primarily of hydrated aluminum silicate in the form of kaolin clay and (2) is cured by baking it (a) for a substantial period at a temperature level exceeding the temperatures that it will be exposed to prior to arc-initiation during such protracted overcurrents, but (b) at a temperature level sufficiently low for the kaolin clay to retain most of its water of hydration. In one embodiment, where protracted overcurrents of as long as approximately one hour are expected before arc-initiation, we rely upon a baking operation that continues for at least approximately one hour at the above-described temperature level. In addition, the temperature during the baking operation is raised to this level progressively over the course of several hours.

In one specific embodiment of the invention, we form the bead 20 by starting with a dry powder comprising the following components by weight percent:

| | |
|---|---|
| Florida kaolin clay ($Al_2Si_2O_7.2\ H_2O$) | 66.7% |
| Milled Zircon ($Zr_2SiO_4$) | 22.3% |
| Boron Phosphate ($BPO_4$) | 11.0% |

These components are thoroughly blended in a mixer to form the powder. To this powder is added a liquid binder in a ratio of 4 parts by weight liquid binder to 15 parts by weight powder. The liquid binder is made from the following components by weight percent:

| | |
|---|---|
| A 50% solution of monoaluminum phosphate ($Al(H_2PO_4)_3$) | 40% |
| Water | 60% |

The liquid binder and the dry powder are thoroughly mixed using a mortar and pestle. The mixed material is then screened through a 12 mesh screen.

The resulting material is then molded in steel dies of a suitable shape to form the blocks 20. Glycerine is preferably used as a mold release. The molding pressure is about 6500 psi.

The molded blocks are then removed from the dies and subjected to the following cure/bake cycle.

a. Air dry at room ambient for 1 hour.
b. Raise temperature to 60° C. at 40° C. per hour.
c. Hold at 60° C. for 1 hour.
d. Raise temperature to 360° C. at 90° C. per hour.
e. Hold at 360° C. for 1 hour.
f. Cool to room temperature in 1 ½ to 2 hours.

The resulting composition is a primarily kaolin clay material that is converted by the baking operating into a hard, rigid solid, but, significantly, a solid which is still not vitrified.

Despite the baking operation, the kaolin clay component of this material has retained over 90 percent by weight of its water of hydration. It is only when temperatures in the range of 465°-600° C. are reached that a large portion of this water of hydration of the kaolin clay is released, more specifically about 77%. As pointed out above, we terminate the baking operation when the temperature is well below this range and therefore do not release this major portion of the water of hydration. The baked material contains a very low percentage of the liquid binder that was used in compounding it since this liquid, which is primarily water, has been mostly evaporated by the baking operation, e.g., the several hours in progressively building up to 360° C. and the one hour at 360° C. Although some of this water, before the baking operation, appears as water of hydration for the boron phosphate, almost all of this water of hydration is released by the baking operation. More specifically, about 90% of boron phosphate's water of hydration is released at temperatures below 260° C.

The zircon additive is an essentially inert filler and does not chemically combine with the water that is used for bonding; and thus there is no significant water vapor evolved from the zircon during the period when the fusible element is being heated by overcurrents.

The monoaluminum phosphate that is used in the binder acts as a ceramic cement for holding the kaolin clay together and gives it increased mechanical stability. Most of the water contained in the monoaluminum phosphate is released by the baking operation and is thus not present to create water vapor during the overcurrent heating period.

Fuses using beads of the above-described material have shown exceptional ability to interrupt low values of overcurrent. Extensive tests have shown that, despite the persistence of low overcurrent for one hour or even longer before an arc is initiated, sufficient quantities of water vapor are retained by the bead material until it is exposed to the arc to enable the fuse to effectively achieve such interruptions. The presence of the boron phosphate component appears to aid in such interruption since its decomposition products have a high electron affinity, thereby contributing to an increased rate of dielectric recovery after a current zero. Although our invention in its preferred form uses boron phosphate as a component of the bead material, the invention in its broader aspects contemplates using for the bead a material primarily of kaolin clay compounded substantially as above described but without the boron phosphate.

It has heretofore been proposed to make the core portion of the fuse of a material which evolves arc-extinguishing gases when exposed to an arc so as to assist in low overcurrent interruptions. A core made of our gas-evolving material, if of the rather intricate cross-sectional configuration shown, has a tendency to develop cracks during the baking operation or during its assembly or use in the fuse, and such cracks constitute dielectrically weak regions that can detract from the insulating properties of the core. We are able to utilize our gas-evolving material without encountering dielectric problems associated with such cracks by employing such material, not in the core, but rather in beads (20) that are relatively small and of low mass compared to the core. Because of their size and low mass the beads can readily be formed and baked as above described without developing any detrimental cracks.

Because we do not rely upon the core (5) for gas evolution, it can be made of an inexpensive, lowmass construction. For example, it can be made of two plates of mica, disposed at right angles to each other. Each of these plates is provided with a centrally located slot (not shown) extending along half its length and permitting the plates to be mated together at right angles to each other. The details of this fuse core form no part of the present invention and are therefore not specifically illustrated or described.

Figure 3:
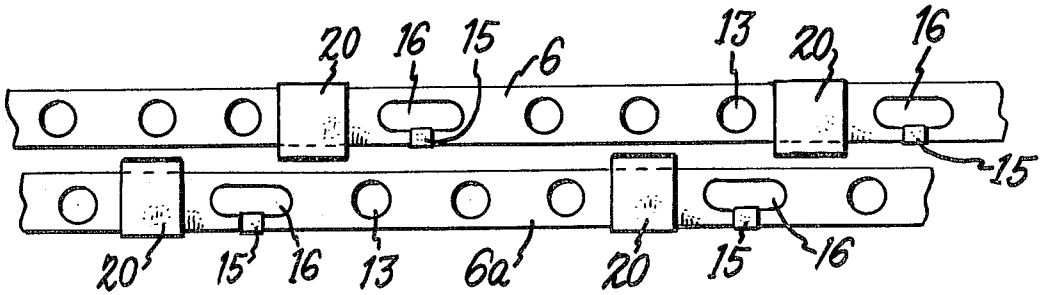
FIG. 3 is a schematic showing of a pair of fusible elements with gas-evolving beads located thereon in accordance with one form of our invention.

In one embodiment, the fuse of this application is so constructed that the beads on a given fusible element not only assist in extinguishing the arcs initiated along that particular fusible element during low overcurrent interruptions, but also assist in extinguishing the arcs initiated along an adjacent element during such interruption. More specifically, referring to the schematic showing of FIG. 3, the beads 20 on the first fusible element 6 are located not only adjacent its own alloy-forming overlays 15 but also adjacent the alloy-forming overlays on the adjacent fusible element 6*a*. As a result, when an arc is initiated at the overlay on the adjacent element 6*a* in response to melting under low overcurrent conditions, an external surface of the bead 20 on element 6 is located in proximity to this arc, and the arc is able to react with the material of the external surface to evolve the desired arc-extinguishing gases to aid in arc extinction.

The material of bead 20, being completely inorganic, is not susceptible to tracking as a result of arcing or other forms of electrical discharge. As a result, its surfaces maintain their dielectric strength and do not form dielectrically weak paths between the fusible elements or across any gaps formed in the fusible elements as a result of fuse operation.

As pointed out above, the monoaluminum phosphate binder and the zircon filler impart mechanical strength and stability to the bead material. This helps the bead 20 withstand without disintegrating or breaking up the combination of pressures and high temperatures that it is exposed to under high current interrupting conditions.

Although, ideally, we bake the beads at a temperature in excess of that which will be reached by the beads during any low overcurrent conditions that the fuse will be exposed to, our invention in its broader aspects contemplates baking at temperatures at least as high as that reached by the beads during prolonged overcurrents as long as one hour. The maximum baking temperature is kept sufficiently low that the hydrated aluminum silicate, or kaolin clay, will retain most of its water of hydration despite the baking operation.

Although we prefer that each bead 20 be slightly spaced from the location where the associated low overcurrent arc will be initiated, as is illustrated in the drawings, our invention in its broader aspects contemplates locating the bead around the arc-initiation location so that the arc is initiated within the bead. In this arrangement, as well as that illustrated, the alloy-forming overlay 15 limits the temperature rise of the bead prior to arc-initiation under low overcurrent conditions to a level sufficiently low to limit to insignificant quantities the volume of gases evolved prior to such arc-initiation.

Although we prefer to use alloy-forming means such as shown at 15 for initiating arcing under low overcurrent conditions, our invention in its broader aspects contemplates the use of other conventional means, such as an overlay of explosive material, for initiating arcing at the elongated perforation 16 in response to the persistence of a low overcurrent for a predetermined prolonged period.

While we have shown only two locations on each ribbon where arcing is initiated in response to low overcurrents, it is to be understood that fewer or more such locations can be provided, as is required for satisfactory interruption. A gas-evolving bead, such as 20, is preferably provided at each such location.

It is noted that in the above description, the terms "gases" and "vapors" are used interchangeably in referring to the products evolved from the bead material.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. A high-voltage current-limiting fuse comprising:

(a) a generally tubular electrically insulating casing, terminal means disposed adjacent each of the opposite ends of the casing, and pulverulent arc-quenching filler within said casing, (b) a ribbon-type fusible element disposed within said filler and electrically interconnecting said terminal means, (c) means at a predetermined location on said fusible element for causing said fusible element to melt at said predetermined location in response to prolonged overcurrents of relatively low value, thereby initiating an arc at said location when said prolonged overcurrents have persisted for a predetermined duration, (d) gas-evolving means for increasing the arc voltage developed by said arc comprising an electrical insulating member disposed about said fuse element in the region of said predetermined location and at a point sufficiently close to said predetermined location that at least a portion of said arc burns within said insulating member and causes vapors to be evolved from the material of said insulating member, (e) said insulating member being of a material that evolves substantially no vapors or gases at the temperatures reached by said member prior to arc-initiation during prolonged overcurrents of up to one hour in duration.

2. The fuse of claim 1 in which said electrical insulating member is spaced a short distance from said predetermined location and said arc, following initiation at said location, burns along said fuse element into said insulating member.

3. A high-voltage current limiting fuse comprising:

(a) a generally tubular electrically insulating casing, terminal means disposed adjacent each of the opposite ends of the casing, and a pulverulent arc-quenching filler within said casing, (b) a ribbon-type fusible element disposed within said filler and electrically interconnecting said terminal means, (c) means at a predetermined location on said fusible element for causing said fusible element to melt at said predetermined location in response to prolonged overcurrents of relatively low value, thereby initiating an arc at said location when said prolonged overcurrents have persisted for a predetermined duration, (d) gas-evolving means for increasing the arc voltage developed by said arc comprising an electrical insulating member disposed about said fusible element in the region of said predetermined location and at a point sufficiently close to said predetermined location that at least a portion of said arc burns within said insulating member and causes vapors to be evolved from the material of said insulating member, (e) said insulating member being primarily of a baked material, a major portion of which is hydrated aluminum silicate including water of hydration that is released only at temperatures in excess of those attained by said insulating member during prolonged overcurrents as long as one hour, (f) said material being baked for several hours at temperatures up to at least the value reached by said insulating member during prolonged overcurrents as long as one hour.

4. The fuse of claim 3 in which said baked material is the reaction product of a mixture of ingredients comprising said hydrated aluminum silicate in the form of kaolin clay, boron phosphate, and an aqueous binder baked for several hours at temperatures gradually raised to around 350° C. and thereafter maintained at between 350° C. and 400° C.

5. The fuse of claim 4 in which said mixture contains a minor percentage of inorganic filler.

6. The fuse of claim 4 in which said mixture contains a minor percentage of zircon.

7. The fuse of claim 3 in which the maximum baking temperature is kept sufficiently low that said hydrated aluminum silicate will retain most of its water of hydration despite the baking operation.

8. The fuse of claim 3 in which:

(a) additional means is provided on said fusible element at a predetermined location spaced from said first location for causing said fusible element to melt at a second location in response to prolonged overcurrents of relatively low value, thereby initiating a second low overcurrent arc at said second location, (b) second gas-evolving means for increasing the arc voltage developed by said second arc comprising a second electrical insulating member disposed about said fusible element in the region of said second location and at a point sufficiently close to said second location that at least a portion of said second arc burns within said second insulating member and causes vapors to be evolved from the material of said second insulating member, (c) said second insuating member being primarily of a baked material conforming to that defined in (e) and (f) of claim 3.

9. A fuse as in claim 3 further comprising:

(a) a core of electrical insulating material about which said first fusible element is wound, (b) a second fusible element electrically in parallel with said first fusible element and wound about said core in close side-by-side relation with said first fusible element, (c) means at a predetermined location on said second fusible element for causing said second fusible element to melt at said second predetermined location in response to prolonged overcurrents of relatively low value, thereby initiating a second arc at said second location when said prolonged overcurrents have persisted for a predetermined duration, (d) said electrical insulating member on said first fusible element being located close to said second location so that said second arc contacts said electrical insulating member and evolves arc-extinguishing gas therefrom.

10. A fuse as in claim 3 further comprising:

(a) a second fusible element electrically in parallel with said first fusible element and disposed in close side-by-side relation with said first fusible element, (b) means at a predetermined location on said second fusible element for causing said second fusible element to melt at said second predetermined location in response to prolonged overcurrents of relatively low value, thereby initiating a second arc at said second location when said prolonged overcurrents have persisted for a predetermined duration, (c) said electrical insulating member on said first fusible element being located close enough to said second location so that said second arc contacts said electrical insulating member and evolves arc-extinguishing gas therefrom.

11. The fuse of claim 3 in which said electrical insulating member is spaced a short distance from said predetermined location and said arc, following initiation at said location, burns along said fuse element into said insulating member.

* * * * *